United States Patent [19]

van der Kooi

[11] 4,393,325

[45] Jul. 12, 1983

[54] LOW-PRESSURE MERCURY VAPOR DISCHARGE LAMP WITH MERCURY AMALGAM

[75] Inventor: Auke G. van der Kooi, Eindhoven, Netherlands

[73] Assignee: U.S. Philips Corporation, New York, N.Y.

[21] Appl. No.: 171,692

[22] Filed: Jul. 24, 1980

[30] Foreign Application Priority Data

Aug. 15, 1979 [NL] Netherlands ..... 7906203

[51] Int. Cl.[3] ..... H01J 61/28; H01J 61/30

[52] U.S. Cl. ..... 313/552; 313/490; 313/634

[58] Field of Search ..... 313/220, 174, 204, 493, 313/490

[56] References Cited

U.S. PATENT DOCUMENTS

| | | | |
|---|---|---|---|
| 2,280,618 | 4/1942 | Besson | 313/174 X |
| 2,501,375 | 3/1950 | Breadner et al. | 313/204 X |
| 3,548,240 | 12/1970 | Spiessens | 313/174 |
| 3,688,148 | 8/1972 | Fedorenko et al. | 313/174 X |
| 3,983,439 | 9/1976 | Blommerde et al. | 313/220 X |
| 4,095,135 | 6/1978 | Yamazaki et al. | 313/220 X |
| 4,288,715 | 9/1981 | Overveld et al. | 313/174 |

*Primary Examiner*—Palmer C. Demeo

*Attorney, Agent, or Firm*—Robert S. Smith

[57] ABSTRACT

The invention relates to a compact low-pressure mercury vapor discharge lamp consisting of a glass inner member which is closely surrounded by a glass cylindrical outer member, one end of which is hemispherical.

The edge at the other end of the outer member is sealed in a gas-tight manner to the inner member. The discharge path between the electrodes may be folded as shown. The discharge is present in a groove, formed in the wall of one of the members. Near the said sealed edge there is an amalgam which is accessible to the discharge space via a narrow channel.

3 Claims, 2 Drawing Figures

LOW-PRESSURE MERCURY VAPOR DISCHARGE LAMP WITH MERCURY AMALGAM

Figure 1:
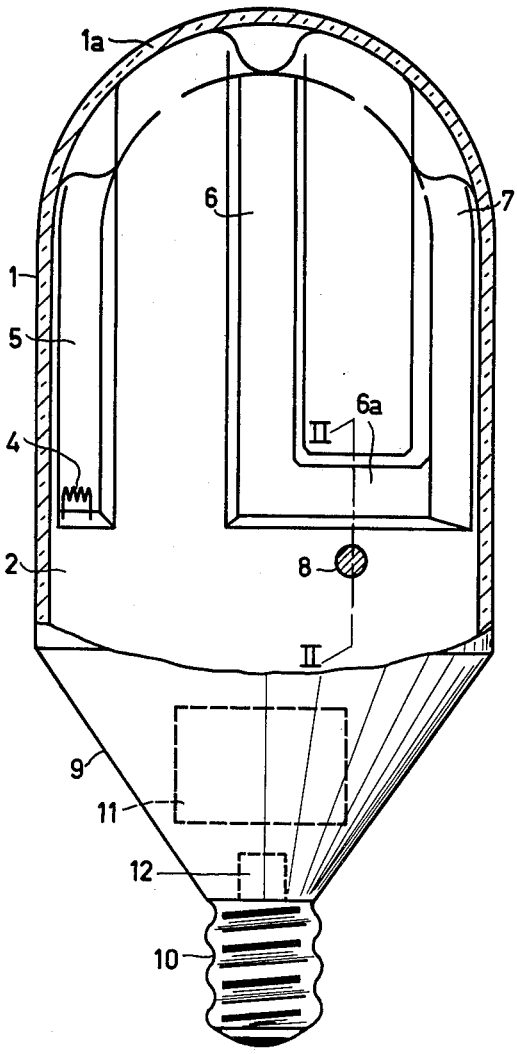

The invention relates to a low-pressure mercury vapor discharge lamp comprising a glass hollow inner member which closely is surrounded with a discharge-tight fit by a predominantly cylindrical sealed glass outer member one end of each member being closed, the two members being sealed in a gas tight manner at their other ends, the lamp also comprising two electrodes between which a discharge takes place during operation of the lamp, said discharge being present in a discharge space formed by a groove in the wall of at least one of the members and the wall portions of the other member which are located opposite this groove.

A discharge-tight fit is defined for present purposes as a fit wherein the two members are dimensioned so that the discharge in the groove is enclosed in a discharge-tight manner, that is to say, the discharge does not leave the groove, so that no short circuit can occur between parts of the discharge path present in two adjacent groove-portions.

A lamp of the type described in the opening paragraph is disclosed in U.S. Pat. No. 4,095,135.

This United States patent specification describes compact low-pressure mercury vapor discharge lamps wherein the discharge path between the electrodes has been folded. Provided they comprise a suitable lamp base (wherein there are, for example, an electric stabilization ballast and a starter) and a cap, (screw or bayonet type), these lamps can be used in luminaires for incandescent lamps for general lighting purposes.

During operation of these known compact lamps circumstances may exist, for example poor ventilation, or when the lamp is operated in places having a relatively high temperature which cause the mercury vapor pressure in the lamp to increase to such a value that the critical mercury vapor pressure for an optimum conversion of electric power into ultra-violet radiation may be easily exceeded. Particularly in compact lamps wherein the electric stabilization ballast in included in the lamp base, the mercury vapor pressure in the discharge space may be too high for the most advantageous conversion efficiency, owing to the relatively high temperature of the ballast during operation of the lamp. The optimum mercury vapor pressure for this purpose is approximately 0.8 Pa. With a higher vapor pressure the luminous flux of the lamp decreases for the same applied power.

The object of the invention is to provide a low-pressure mercury discharge lamp for which measures have been taken to stabilize the mercury vapor pressure at a relatively high operating temperature.

This object is accomplished with a low-pressure mercury vapor discharge lamp of the type described in the opening paragraph which according to the invention is characterized in that near the sealed edge there is an amalgam present on or adjacent to a wall portion, which is not in but accessible to the discharge space via a channel defined by facing surfaces of the two members.

It was found that particularly in a lamp according to the invention, comprising a lamp base including an electric stabilization ballast this is the most advantageous position to apply the amalgam for the most advantageous conversion efficiency.

The invention can be advantageously used in lamps wherein the inner member is enveloped by the outer member with a small clearance. The mercury amalgam is then not only in connection with the portion of the groove which is closest to it but also with the entire space between the two members. Consequently, the mercury vapor pressure can then be stabilized by the amalgam in a simple and rapid manner, also in, even in the more remote portions of the groove (the groove may, for example, have a folded shape).

It should be noted that it is known, for example in highly loaded tubular low-pressure mercury vapor discharge lamps, to dispose an alloy in the discharge vessel which forms an amalgam with mercury in order to control the mercury vapor pressure in the discharge vessel. Such an amalgam is then often applied to the inside of the discharge vessel wall, for example in a place behind the electrode. In a lamp according to the invention, however it was found that, as the lamp is very poorly cooled only owing to its compactness, such a place behind the electrode or a different place of the wall of a groove where the discharge is present assumes a temperature which is still too high for a satisfactory vapor pressure stabilization.

The amalgam may be applied in different manners to the wall of one of the members, for example by means of a bonding agent. In a lamp according to the invention, the amalgam may be located in a recessed portion in the wall of one of the members, preferably in the wall of the inner member. The recess is accessible to the discharge space, for example via a channel which is defined by the facing walls of the two members. This embodiment has the advantage that the amalgam is bondable to the wall on a larger portion of its surface area. Furthermore, a relatively large quantity of the amalgam can be applied to a comparatively small portion of the wall.

In a further embodiment of a lamp according to the invention the amalgam is present in a metal container having an opening. Measures should be taken during the production or operation of the lamp to prevent the amalgam or the amalgam-producing alloy from becoming detached from the wall and from moving to any random position in the lamp. The container is preferably disposed in the above-mentioned recess in the wall of the inner member. The container is kept in place by the adjoining wall of the outer member.

Figure 2:
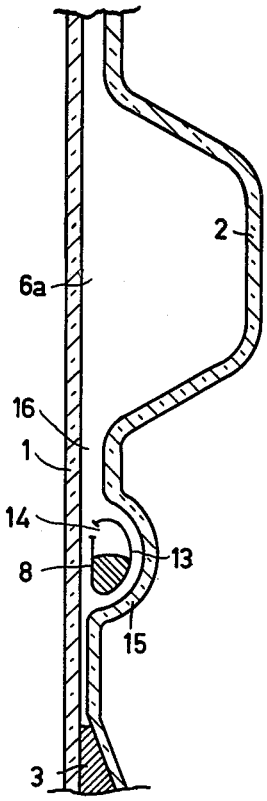

Embodiments of the invention will now be further explained with reference to the accompanying drawing, of which FIG. 1 shows schematically an embodiment of a low-pressure mercury vapor discharge lamp according to the invention and FIG. 2 is a cross-sectional view along the plane II—II of the position of an amalgam in a lamp as shown in FIG. 1.

The lamp shown in FIG. 1 comprises a glass cylindrical outer member 1 having a hemispherical end 1*a*. It encloses with a discharge-tight fit (with a clearance of, for example, 0.1 to 1.5 mm) a glass inner member 2. At the other end the members are bonded together around the edge of member 1 in a gas-tight manner with glass enamel 3. The lamp comprises two electrodes between which a discharge takes place during operation of the lamp. The drawing shows only one of these electrodes (4). The discharge path is extended by folding. The discharge space is defined by a folded groove formed in the wall of the inner member and by the outer member wall portions located opposite this groove. This visible portions of the groove are denoted by the numerals 5, 6 and 7. As viewed in the drawing, the discharge path extends upwards from electrode 4 via portion 5, reverses thereafter to continue its way via a bridge portion, (not shown) on the back to the top of groove portion 6 and then via portion 6, bridge portion 6*a* and portion 7 to the other electrode (not shown) at the back of the lamp. A mercury amalgam 8 is present near the connecting edge 3. This amalgam is applied to a wall portion which is accessible to the discharge space (see FIG. 2). The lamp further comprises a lamp base 9 with screw cap 10. The lamp base includes an electric stabilization ballast 11 and a starter 12.

FIG. 2 is a cross-sectional view through the plane II—II of the lamp shown in FIG. 1. Corresponding components have been given the same reference numerals. The amalgam (consisting, for example, of indium, bismuth and mercury) is present in a metal container 13 having opening 14. This container is disposed in a recess 15 formed in the wall of the inner member 2. The recess is accessible to the discharge space via a narrow channel 16, which is defined by the facing walls of members 1 and 2 and which opens into groove portion 6*a*. The channel is automatically provided when members 1 and 2 are assembled in close relationship during production due to their configurations. The clearance between 1 and 2 should be sufficiently narrow to avoid the risk that the discharge may be short-circuited during operation of the lamp, for example so that the discharge cannot jump from portion 5 to portion 6.

In one embodiment of a lamp according to the invention a layer of luminescent material is applied to the inside of the groove wall and to the portion of the outer member wall facing the groove. The remaining portions of the members are free from luminescent material. The luminescent material consists of a mixture of two phosphors, namely green-luminescing, terbium-activated cerium magnesium aluminate and a red-luminescing, trivalent europium-activated yttrium oxide. In this embodiment the discharge path consists of six parallel, interconnected groove portions, the discharge path having a length of 40 cm, the distance from the seal 3 to the top of the glass outer member being approximately 8 cm. The outer diameter of member 1 is approximately 6 cm. The average spacing between the two members 1 and 2 other than in the region of the grooves is about 0.5 mm. In addition to approximately 8 mg of mercury the lamp contains a quantity of approximately 80 mg of an indium-bismuth alloy (50–50% by weight) as the amalgam forms alloy. With a rare gas filling of argon at a pressure of 400 Pa, the luminous flux of the lamp was 1000 lumen at an applied power to the lamp together with the 19 W electric ballast. (Power 19 W).

In the embodiment described with reference to the drawing, the discharge path is defined by a groove formed in the wall of the inner member 2 and the ungrooved wall of the outer member 1. It is of course, alternatively possible to provide such a groove in the outer member 1 only or to provide corresponding grooves in both members.

What is claimed is:

1. A low-pressure mercury vapor discharge lamp comprising a hollow glass inner member which is closely surrounded with a discharge-tight fit by a predominantly cylindrical, glass outer member, one end of each member being closed, the two members being sealed together in a gas-tight manner at their ends, the lamp also comprising two electrodes between which a discharge takes place during operation, said discharge being present in a discharge space between the electrodes formed by a groove in the wall of at least one of the members and by the wall portions of the other member, located opposite this groove, characterized in that intermediate the sealed edge and the discharge space there is a mercury amalgam present on or adjacent to a wall portion which is not in but is accessible to the discharge space via a channel defined by facing surfaces of the two members.

2. A low-pressure mercury vapor discharge lamp as claimed in claim 1, characterized in that the mercury amalgam is disposed in a recess formed in the wall of one of the members.

3. A low-pressure mercury vapor discharge lamp as claimed in claim 1 or 2, characterized in that the amalgam is contained in a metal container having an opening.

* * * * *